US005351716A

United States Patent [19]

Korthaus

[11] Patent Number: 5,351,716

[45] Date of Patent: Oct. 4, 1994

[54] CONCRETE DISTRIBUTOR SYSTEM

[76] Inventor: Ernst Korthaus, Gehringer Schlade 7, 5983 Balve, Fed. Rep. of Germany

[21] Appl. No.: 95,007

[22] Filed: Jul. 22, 1993

[30] Foreign Application Priority Data

Jul. 22, 1992 [DE] Fed. Rep. of Germany ..... 4224162

[51] Int. Cl.[5] ..... E03B 5/00

[52] U.S. Cl. ..... 137/615; 137/565; 138/30; 285/112

[58] Field of Search ..... 138/30; 137/615, 565; 417/540; 285/112

[56] References Cited

U.S. PATENT DOCUMENTS

| | | | |
|---|---|---|---|
| 2,609,001 | 9/1952 | Hebard | 138/30 |
| 3,103,234 | 9/1963 | Washburn | 138/30 |
| 3,353,560 | 11/1967 | McCulloch | 138/30 |
| 3,707,990 | 1/1973 | Schaible et al. | 137/615 |
| 3,874,417 | 4/1975 | Clay | 138/30 |
| 4,163,571 | 8/1979 | Nash | 285/112 |

*Primary Examiner*—A. Michael Chambers
*Attorney, Agent, or Firm*—Walter Ottesen

[57] ABSTRACT

The invention is directed to a concrete distributor system which includes a concrete delivery pump, a connecting delivery conduit leading to a multi-part concrete distributor mast and a concrete conveying conduit integrated with the concrete distributor mast and connected to the connecting delivery conduit. The pump imparts pulse-like movements to the concrete and a pipe damper is mounted into one of the conduits to attenuate the pulse-like movements of the concrete as the concrete flows through the conduits.

10 Claims, 2 Drawing Sheets

CONCRETE DISTRIBUTOR SYSTEM

FIELD OF THE INVENTION

The invention relates to a concrete distributor system which includes a concrete delivery pump, a connecting delivery conduit leading to a multi-part concrete distributor mast and a concrete conveying conduit integrated with the concrete distributor mast and connected to the connecting delivery conduit. The concrete conveying conduit has an inner diameter which is greater than 75 mm and less than 250 mm.

BACKGROUND OF THE INVENTION

A concrete distributor system can be stationary at a construction site or can be configured as a mobile system mounted on a truck.

With the known concrete distributor system, it is necessary that the occurring inertial forces generated by the pumping operation be accounted for in the construction and configuration of the individual elements of the system. This requirement has been satisfied in that the basic principles have been determined for the computation of distributor masts for concrete pumps which are, as a rule, piston pumps. These basic principles are embodied in German Industrial Standard 24117 (DIN 24117). The concrete pump imparts a pulse-like movement to the concrete flowing through the delivery and conveying conduits.

The distributor mast is stressed by the pulse-like movement of the concrete in the rigid and flexible pipe sections with the concrete having a bulk density of up to 2.40 kg/dm$^3$. For this reason, the values of the operating load and the dead load are multiplied by 1.3 and 1.2, respectively. The operating loads are the maximum weight forces of the material conveyed in the pipe line which results from the selection of the pipe line dimensions which form the basis of the computation.

The required increase of the computation values by 20% and 30% leads perforce to more weight and therefore to less flexibility of the total system configuration and this is especially the case for mobile systems.

SUMMARY OF THE INVENTION

It is an object of the invention to considerably reduce or avoid the disadvantages associated with previously known concrete distributor systems constructed pursuant to DIN 24117.

The concrete distributor system of the invention includes: a concrete delivery pump for pumping the concrete so as to impart a pulse-like movement thereto; a multi-part concrete distributor mast; a concrete delivery conduit mounted on the mast; a connecting delivery conduit connecting the pump to the concrete delivery conduit; and, pipe damper means mounted in one of the conduits for attenuating the pulse-like movements of the concrete as the concrete flows through the conduits.

In the concrete distributor system according to the invention, it has been shown to be advantageous that the stress caused by the pulse-like movement of the concrete is noticeably reduced. It is even possible to reduce the above-mentioned required value of 1.3 with respect to the operating load value.

The pulse-like movement applied to the concrete flowing through the concrete conveying conduit mounted on the mast tends to impart a whip-like movement to this conduit and the mast on which it is mounted. This to-and-fro motion of the concrete delivery conduit can be dangerous for the worker holding the end portion of the concrete delivery conduit in the event that this person is required to stand on a narrow plank on a construction scaffold. Accordingly, it is especially advantageous that the concrete conveying conduit as a discharge line is considerably less subjected to to-and-fro motion because of the installation of the pipe damper operating as a pulse attenuator. Also, the bearings at the articulated joints of the concrete distributor mast are subjected to reduced load and therefore have a longer service life because of the lesser pulse-like movement of the concrete in the conduits.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
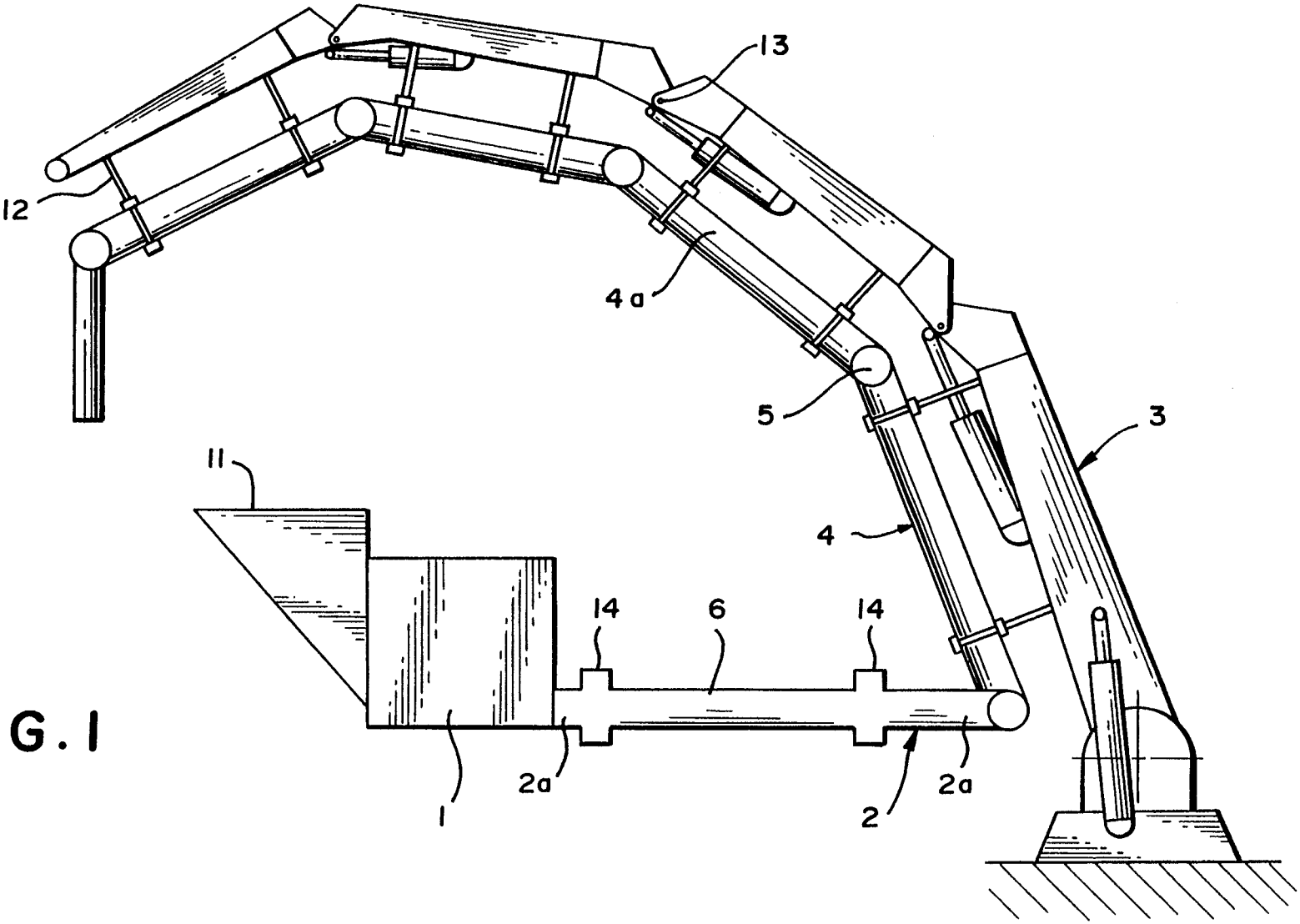
FIG. 1 is a schematic representation of a concrete distributor system equipped with a pipe damper.

The concrete distributor system of the invention shown in FIG. 1 includes: a concrete pump 1 and a fill hopper 11 corresponding thereto; a connecting delivery conduit 2 leading to the multi-part concrete distributor mast 3 which, as a rule, is an articulated mast; and, the concrete conveying conduit 4 integrated into the concrete distributor mast 3. The conduit 4 comprises a plurality of conduit sections 4*a* and is mounted on the mast 3 with a plurality of holding brackets 12. The concrete conveying conduit 4 has several pivot points 5 at locations corresponding to the articulated joints 13 of the mast 3 and is connected to the connecting delivery conduit 2. The conduit 2 can likewise comprise a plurality of conduit sections 2*a*. The conduit sections 2*a* are connected to a pipe damper 6 by couplings represented schematically in FIG. 1 by projections 14.

The pipe damper 6 is so constructed that it can be installed and removed in the same manner as the other conduit sections of the concrete delivery conduit 2 or the concrete conveying conduit 4. In the embodiment shown, the pipe damper 6 is integrated into the connecting delivery conduit 2.

The concrete distributor system can be mounted as a stationary system at a construction site or it can be mounted as a mobile system on a truck.

Figure 2:
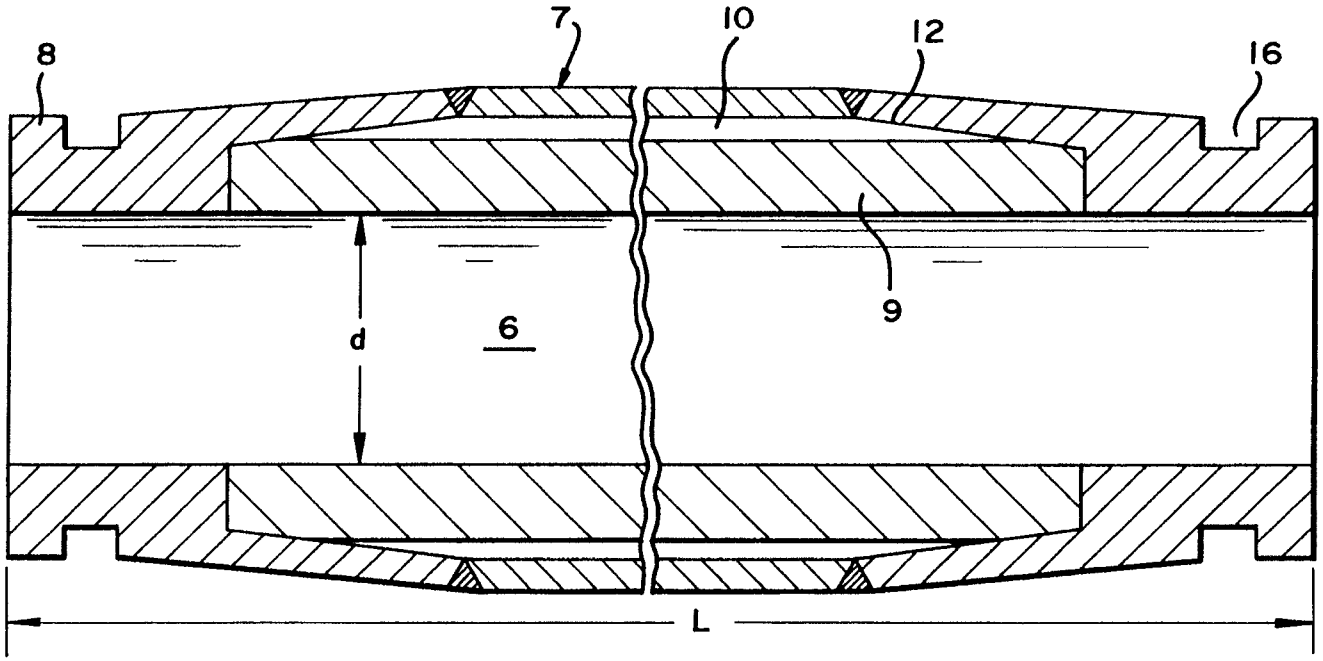
FIG. 2 is a longitudinal section view of the pipe damper.
Figure 3:
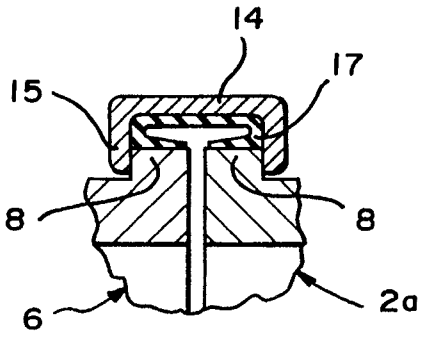
FIG. 3 is a schematic detail view of a coupling holding two mutually adjacent conduit sections together.

The pipe damper 6 shown in FIG. 2 is a welded joint construction and essentially includes a multi-part outer steel pipe 7 having annular flange collars 8 at both longitudinal ends thereof to facilitate mounting of couplings 14 such as the kind shown in FIG. 3. The coupling 14 shown in FIG. 3 is provided for joining two mutually adjacent conduit sections together. The legs 15 of the coupling engage into respective ones of the recesses 16 of the mutually adjacent conduit sections. A seal 17 is provided at the interface of the coupling 14 and the annular flange collars 8 as shown. The coupling and appropriate dimensions therefor are provided in German Industrial Standard 24118 (DIN 24118).

Pieces of aggregate ill the concrete sometimes become lodged in the conduit so that it is necessary to stop the concrete pump, disengage the appropriate coupling and remove the obstructing piece or pieces of aggregate.

The pipe damper 6 further includes a hose section 9 mounted in the interior of steel pipe 7. The hose section 9 is made of polyurethane. The hardness of the polyurethane should be more than Shore D 27 which corresponds to a Shore A hardness of approximately 78.

A hollow annular space 10 remains between the outer steel pipe 7 and the inner polyurethane hose section 9. The hose section 9 expands into the hollow space 10 in response to pulsating loads of concrete passing through the concrete delivery conduit 2 and thereby reduces the shock action of the pulse-like movement of the concrete.

The steel pipe 7 limits the extent to which the hose section can expand and prevents the hose section 9 from bursting.

The hollow annular space 10 is a closed space. According to another feature of the invention, the space 10 can be filled with compressed air at a slight overpressure so that this trapped air and the expanded hose section 9 conjointly define an air spring. The characteristic of the pipe damper can be adjusted by adjusting the pressure of the compressed air in the space 10.

The steel pipe 7 includes a conical inner surface 12 at both ends of the steel pipe 7 and the inner contours of the ends of the steel pipe as well as the inner contour of the hose section conjointly provide a continuous smooth uninterrupted wall surface so that no stopper action can occur as the concrete passes through.

It is advantageous when the pipe damper 6 has a longitudinal length (L) which is at least 10 times the inner diameter (d) of the hose section 9.

The steel parts which come into contact with the flowing concrete can be hardened to increase service life.

It is understood that the foregoing description is that of the preferred embodiments of the invention and that various changes and modifications may be made thereto without departing from the spirit and scope of the invention as defined in the appended claims.

What is claimed is:

1. A concrete distributor system comprising:

a concrete delivery pump for pumping the concrete so as to impart a pulse-like movement thereto;

a multi-part concrete distributor mast;

a concrete delivery conduit mounted on said mast;

a connecting delivery conduit connecting said pump to said concrete delivery conduit thereby subjecting said conduits to a shock action because of said pulse-like movement;

each of said conduits defining a longitudinal axis;

pipe damper means mounted in one of said conduits for attenuating the pulse-like movements of said concrete as the concrete flows through said conduits;

said pipe damper means including a hose section connected into one of said conduits along the longitudinal axis thereof;

said hose section being defined by an uninterrupted solid annular wall having an inner wall surface defining a clear uninterrupted interior space for conducting said concrete therethrough and for being in direct contact with said concrete as said concrete flows therethrough; and, said annular wall being made of resilient material for expanding in response to the pulsating load of said concrete thereby attenuating said shock action on said conduits.

2. The concrete distributor system of claim 1, said concrete delivery conduit having an inner diameter greater than 75 mm and less than 250 mm.

3. The concrete distributor system of claim 1, said pipe damper means further comprising:

an outer steel pipe defined by an annular steel wall having inner and outer wall surfaces;

said hose section being disposed inside said annular steel wall; and, said hose section and said inner wall surface conjointly defining a closed annular hollow space into which said hose section can expand in response to pulse-like movements of the concrete flowing through said hose section.

4. The concrete distributor system of claim 3, said conduits each including a plurality of conduit sections and said system further comprising coupling means for coupling each two mutually adjacent ones of said conduit sections together with one of said conduit sections being said outer steel pipe containing said hose section.

5. The concrete distributor system of claim 4, said hose section being made of polyurethane and having a hardness corresponding to Shore D 27.

6. The concrete distributor system of claim 4, said hose section having a predetermined length and having a hardness which varies along said length.

7. The concrete distributor system of claim 3, said outer steel pipe having a predetermined length (L) and said hose section having a predetermined inner diameter (d); and, said diameter (d) and said length (L) defining a ratio d/L greater than 1:10.

8. The concrete distributor system of claim 3, said outer steel pipe including a plurality of annular segments welded one to the other; said hose section having first and second longitudinal ends; and, adhesive means for gluing said pipe to said hose section at said first and second longitudinal ends thereof.

9. The concrete distributor system of claim 7, said hose section having a longitudinal length less than said length (L) of said outer steel pipe thereby causing portions of said inner wall surface to come into contact with the concrete; and, said outer steel pipe being hardened in those regions thereof corresponding to said portions of said inner wall surface.

10. The concrete distributor system of claim 3, said closed annular space being filled with a compressed gas at a slight overpressure trapped in said space so as to cause the trapped gas and said hose section to conjointly define an air spring for attenuating said shock action on said conduits.

* * * * *